US005897045A

United States Patent [19]

Olvera et al.

[11] Patent Number: 5,897,045

[45] Date of Patent: Apr. 27, 1999

[54] FASTENER DISPENSING APPARATUS FOR STAND-UP FASTENER DRIVING TOOL AND METHOD THEREFOR

[75] Inventors: Gilbert Olvera, Chicago; Sigismund G. Paul, Park Ridge; George G. Dewey, Palatine, all of Ill.

[73] Assignee: Illinois Tool Works Inc., Glenview, Ill.

[21] Appl. No.: 08/928,593

[22] Filed: Sep. 12, 1997

[51] Int. Cl.[6] ..... B25C 5/06

[52] U.S. Cl. ..... 227/119; 227/107; 227/139

[58] Field of Search ..... 227/107, 119, 227/135, 138, 139

[56] References Cited

U.S. PATENT DOCUMENTS

| | | | |
|---|---|---|---|
| 1,073,348 | 9/1913 | Hoagland . | |
| 3,960,191 | 6/1976 | Murray | 144/32 R |
| 4,199,093 | 4/1980 | Combette et al. . | |
| 4,389,012 | 6/1983 | Grikis et al. | 227/120 |
| 4,573,610 | 3/1986 | Hurner . | |
| 4,674,367 | 6/1987 | Aab et al. | 81/57.37 |
| 4,824,003 | 4/1989 | Almeras et al. . | |
| 4,995,543 | 2/1991 | Earl | 227/113 |
| 4,998,660 | 3/1991 | Kanzaka | 227/18 |
| 5,192,012 | 3/1993 | Schafer et al. | 227/113 |
| 5,193,729 | 3/1993 | Dewey et al. . | |
| 5,199,506 | 4/1993 | Dewey et al. . | |
| 5,199,625 | 4/1993 | Dewey et al. | 173/104 |
| 5,302,068 | 4/1994 | Janusz et al. | 411/402 |
| 5,692,664 | 12/1997 | Vettoretti et al. | 227/10 |

OTHER PUBLICATIONS

ITW Buildex, "UNIDEK™ Stand–Up Metal Deck Fastening System", 1996, 1 page.

*Primary Examiner*—Peter Vo
*Assistant Examiner*—Bobby Rushing, Jr.
*Attorney, Agent, or Firm*—Schwartz & Weinrieb

[57] ABSTRACT

A stand-up fastener driving tool including a rotary driver having a rotatable shaft with a fastener driving member disposed on a distal end thereof and disposed within telescoping upper and lower tubes, wherein the lower tube has a nose-piece with an opening for retaining a fastener therein. The fastener driving member is extendable toward and away from the nose-piece upon contraction and extension of the lower and upper tubes. A plurality of fasteners are retained side by side in a magazine of the tool, and are individually releasable therefrom upon contraction and extension of the upper and lower tubes. A feed tube connects the magazine to the nose-piece, and includes a magnetized wall portion for capturing and retaining fasteners fed from the magazine. A plunger actuatably coupled to the upper tube and movable relative to the feed tube releases the fastener retained along the magnetized wall portion of the feed tube as the lower and upper tubes are contracted, wherein another fastener is released from the magazine toward the feed tube as the lower and upper tubes are extended.

25 Claims, 4 Drawing Sheets

FASTENER DISPENSING APPARATUS FOR STAND-UP FASTENER DRIVING TOOL AND METHOD THEREFOR

CROSS-REFERENCE TO RELATED APPLICATION

The present patent application is related to copending U.S. application No. 08/928,594, filed on Sep. 12, 1997 entitled "Fastener Collation Tube for Stand-Up Fastener Driving Tool", incorporated by reference herein.

FIELD OF THE INVENTION

The present invention relates generally to stand-up fastener driving tools, and more particularly to apparatus and method for actuatably dispensing collated screw fasteners from a fastener magazine and feeding the dispensed fasteners to a nose-piece of a stand-up fastener driving tool for installation into a workpiece.

BACKGROUND OF THE INVENTION

The advent of stand-up fastener driving tools marked a significant advance in the installation of fasteners through overlapping members and into an underlying support member, collectively referred to herein as a deck, as is conventional in the roofing and flooring industries. U.S. Pat. No. 5,302,068 entitled "Fastener Having Recessed Non-Circular Head, and Fastener-Driving Tool" issued to Janusz et al. on Apr. 12, 1994 and commonly assigned herewith, for example, discloses a stand-up screw gun generally including a trigger actuatable rotary driver, which is an industrial quality hand-held electric tool, coupled to a screw driving member, with a socket portion, by a rotatable shaft extending through an outer upper tube coupled to the rotary driver and an inner lower tube telescopingly biased away from the rotary driver by means of a compressed spring member disposed within the upper tube.

The screw driving member of U.S. Pat. No. 5,302,068 is movable from an inoperative position to an operative position relative to a nose-piece coupled to a distal end of the inner lower tube upon depressing the nose-piece against the deck so as to telescopingly move the inner lower tube toward the rotary driver against the bias of the compressed spring member. In the operative position, the socket portion engages a screw retained in a screw driving position between pivotal jaws of the nose-piece so that the screw is aligned axially with the screw driving member, whereupon continued depression of the nose-piece against the deck pivotally opens the jaws so as to release the screw and extends the screw driving member through the nose-piece, thereby driving the screw into the deck. According to a related aspect of U.S. Pat. No. 5,302,068, the screw driving member includes a spring biased centering pin with a convex end disposable in a concave recess formed in the screw head for axially centering the screw with the screw driving member, and more particularly with the socket portion thereof. In one embodiment, the convex end of the centering pin and the concave recess of the screw have complementary frusto-conical surfaces so as to rotationally orient the screw relative to the socket portion of the screw driving member, thereby facilitating engagement of the screw by the socket portion.

The stand-up screw gun of U.S. Pat. No. 5,302,068 also includes a screw feed tube disposed alongside the telescoping upper and lower tubes. An upper end of the feed tube includes a funnel to facilitate manual insertion of screws therein, wherein the screws are gravity fed from the upper end of the feed tube toward a lower end thereof, which is coupled to the nose-piece by a mounting block. A passage through the mounting block directs screws from the feed tube to the screw driving position between the pivotal jaws of the nose-piece when the screw driving member is retracted away from the nose-piece in the inoperative position. Stand-up screw guns incorporating these and other aspects of the invention disclosed in U.S. Pat. No. 5,302,068 are available commercially from ITW Buildex, Itasca, Ill. under the trademarks Autotraxx™ and Fastraxx™.

In many stand-up fastener driving tools, including the stand-up screw gun of U.S. Pat. No. 5,302,068, the operator must insert each screw into the feed tube individually, wherein a second screw cannot be inserted into the feed tube until the previously inserted screw has been driven into the deck. Feeding more than one screw into the feed tube may result in obstruction of the screw driving member as it moves between the inoperative and operative positions. And feeding a second screw into the feed tube while the screw driving member is in the operative position may prevent the screw driving member from retracting fully away from the nose-piece after installation of a previously fed screw. The inventors of the present invention recognize the desirability of eliminating the necessity of manually inserting each screw into the feed tube prior to installation, but only after a previously inserted screw has been installed into the deck, which is time consuming and distracting.

Others have endeavored to provide improved fastener loading features in stand-up fastener driving tools. U.S. Pat. No. 3,960,191 entitled "Fastener Feeding and Driving Attachment" issued to Murray on Jun. 1, 1976, commonly assigned herewith, for example, discloses a stand-up screw gun having a feed tube for retaining a plurality of screws therein. The feed tube is coupled to a nose-piece disposed on an end of a telescoping tube assembly. A pivotal arm alternately positions ears at opposite ends thereof into the feed tube during retraction and extension of the telescoping tubes, wherein the ears of the pivotal arm release one of a plurality of screws retained in the feed tube toward the nose-piece as the telescoping tube assembly is extended after installation of a previously released screw. More recently, U.S. Pat. No. 5,199,625 entitled "Fastener Driving Tool Assembly With Improved Fastener-Loading Features", issued on Apr. 6, 1993 to Dewey et al., also commonly assigned herewith, discloses a flexible tube for retaining several pins disposed therein, and for directing the pins into a slot formed in a nose-piece of a stand-up fastener driving tool. A shuttle member is movable transversely in the slot toward an aperture of the nose-piece so as to transfer a pin disposed in the slot to the aperture of the nose-piece where the pin is retained by a magnet in axial alignment with the pin driving member until the pin is engaged thereby. The shuttle permits only one pin at a time from dropping from the feed tube into the slot, which occurs when the shuttle is retracted away from the aperture of the nose-piece.

The configurations of U.S. Pat. Nos. 5,302,068 and 3,960,191 require that the screws be loaded individually into the feed tube by the operator, which is often a distracting and arduous task in the field, particularly during inclement weather conditions and at precarious work sites. And although the configurations of U.S. Pat. Nos. 5,199,625 and 3,960,191 include a fastener feed tube portion for retaining a plurality of screws or pins therein for use during tool operation, the screws or pins must be loaded, or stacked, into the feed tube in a head-to-point relationship, which limits the number of fasteners retainable therein.

The present invention is directed toward novel advancements in the art of retaining and dispensing fasteners in stand-up fastener driving tools.

OBJECTS AND SUMMARY OF THE INVENTION

It is thus an object of the present invention to provide a novel stand-up fastener driving tool and method therefor that overcome problems with the prior art, and that are economical, reliable, and integratable or retrofittable with existing stand-up fastener driving tools, and to provide a novel method and apparatus for retaining and dispensing collated fasteners from a fastener magazine and feeding the dispensed fasteners to a nose-piece of a stand-up fastener driving tool, and combinations thereof.

It is a more particular object of the invention to provide a novel stand-up fastener driving tool including a rotary driver having a rotatable shaft with a fastener driving member disposed on a distal end thereof. A lower tube is telescopingly coupled to an upper tube coupled to the rotary driver, wherein the lower tube is biased away from the rotary driver by a spring member, and a nose-piece is coupled to the lower tube, wherein the nose-piece includes an opening for retaining a fastener axially aligned with the fastener driving member. The fastener driving member is extendable toward the nose-piece upon contraction of the lower and upper tubes against the bias of the compressed spring, and the fastener driving member is retractable away from the nose-piece upon extension of the lower and upper tubes. A plurality of fasteners are retained side by side in a magazine by upper and lower pins actuatably extendable into and retractable out of the magazine. The upper pin is extended into the magazine so as to retain the fasteners therein and the lower pin is retracted out of the magazine as the lower and upper tubes are extended, and alternately the lower pin is extended into the magazine so as to retain the fasteners therein and the upper pin is retracted out of the magazine as the lower and upper tubes are contracted. The fasteners are individually and sequentially released from the magazine toward a feed tube interconnecting the magazine and the nose-piece upon extension and contraction of the lower and upper tubes.

It is another object of the invention to provide a novel stand-up fastener driving tool as discussed generally above including a cam member actuatably coupled to the upper tube and movable relative to the magazine upon contraction and extension of the lower and upper tubes. The upper and lower pins are biased into the magazine, wherein the cam member pivots a first pivotal member so as to retract the lower pin from the magazine as the lower and upper tubes are extended, and the cam member pivots a second pivotal member so as to retract the upper pin from the magazine as the lower and upper tubes are contracted.

It is also an object of the invention to provide a novel stand-up fastener driving tool wherein the feed tube includes a magnetized wall portion for capturing and retaining a fastener fed from the magazine along the magnetized wall portion of the feed tube. A plunger actuatably coupled to the upper tube and movable relative to the feed tube releases the fastener retained along the magnetized wall portion of the feed tube as the lower and upper tubes are contracted. And it is a related object of the invention to provide a blade member having a lower angled tip extendable into the magazine as the lower and upper tubes are contracted, whereby the angled tip of the blade member is engageable with a shank of a fastener retained along the magnetized wall portion of the feed tube so as to more substantially axially align the fastener shank with the feed tube axis before the fastener is released therefrom and fed toward the nose-piece.

It is a further object of the invention to provide a novel stand-up fastener driving tool having a nose-piece with jaws for retaining a fastener released from along the magnetized wall portion of the feed tube in a fastener driving position in alignment with the fastener driving member as the lower and upper tubes are extended, whereby the fastener driving member is engageable with the fastener retained between the jaws of the nose-piece as the lower and upper tubes are subsequently contracted, and whereby the jaws are movable apart so as to release the fastener therefrom upon further contraction of the lower and upper tubes.

It is a further object of the invention to provide a novel stand-up fastener driving tool having a tube holder coupled to the magazine, and a fastener collation tube for retaining a plurality of fasteners arranged side by side in a channel thereof. The fastener collation tube is disposable in the tube holder so as to couple the channel of the fastener collation tube with the magazine, whereby the fasteners in the fastener collation tube are transferrable therefrom and into the magazine in the side by side arrangement, and the stand-up fastener driving tool is operable when the fastener collation tube is disposed in the channel of the tube holder.

It is yet another object of the invention to provide a novel stand-up fastener driving tool having a tube holder useable in combination with a fastener collation tube having one or more fastener retaining members disposed toward at least one end of the fastener collation tube so as to engagably retain the plurality of fasteners therein. A corresponding prong extending into the tube holder disengages the fastener retaining member from the fasteners disposed in the fastener collation tube when the fastener collation tube is disposed in the tube holder, whereby fasteners are released from the fastener collation tube and transferred into an upper portion of the magazine from where the fasteners are sequentially dispensed toward the nose-piece upon contraction and extension of the upper and lower tubes thereof.

BRIEF DESCRIPTION OF THE DRAWINGS

The foregoing and other objects, features, aspects and advantages of the present invention will become more fully apparent upon careful consideration of the following Detailed Description of the Invention and the accompanying Drawings, which may be disproportionate for ease of understanding, wherein like structure and steps are referenced generally by corresponding numerals and indicators, throughout the several views, and wherein.

DETAILED DESCRIPTION OF THE INVENTION

Figure 1A:
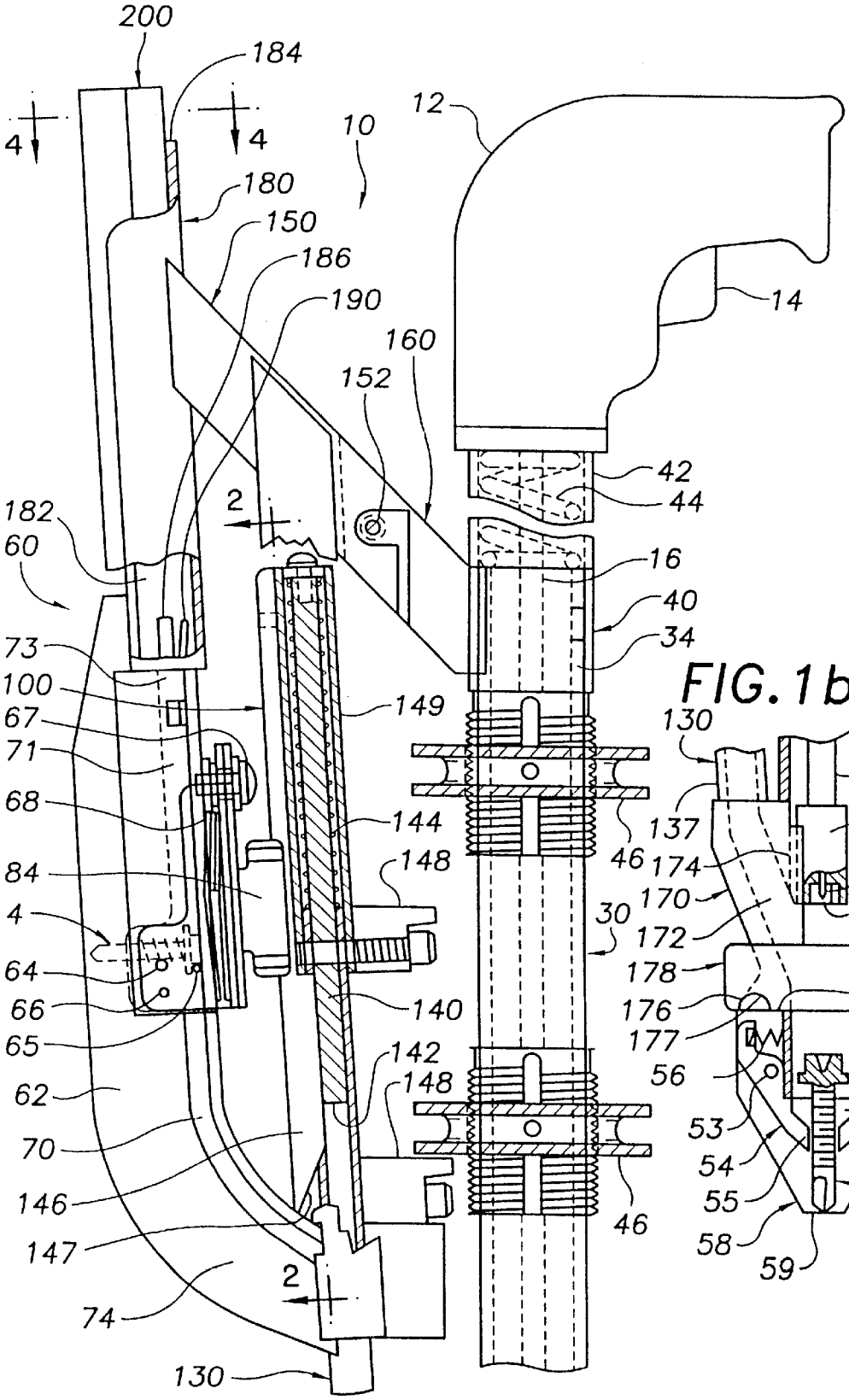
FIG. 1*a* is a partial side view of an upper portion of a stand-up fastener driving tool including a fastener magazine and dispenser assembly according to an exemplary embodiment of the invention.
Figure 1B:
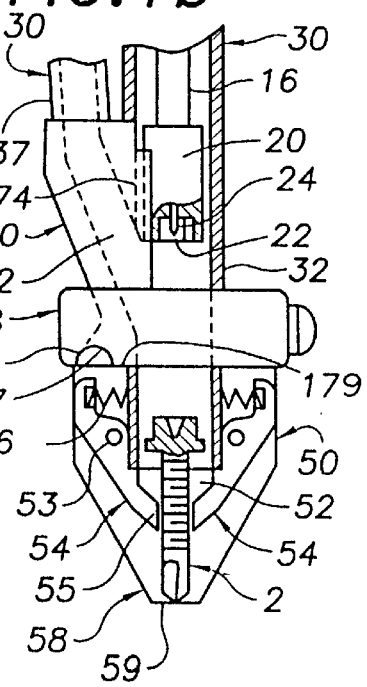
FIG. 1*b* is a partial side view of a lower portion of a stand-up fastener driving tool including a nose-piece thereof, which forms a part of the stand-up fastener driving tool of FIG. 1*a*.

FIGS. 1*a*–1*b* illustrate a fastener driving tool 10 generally comprising a rotary driver 12, which may be a hand-held electric tool actuatable by a trigger 14, having a rotatable shaft 16 with a fastener driving member 20 disposed on a distal end thereof. The exemplary fastener driving member 20 includes a socket 22 engageable with a head having a frusto-conical shaped recess and an axially aligned pin 24 biased into the recess for aligning a fastener 2 with the socket 22 as disclosed more fully in an embodiment of U.S. Pat. No. 5,302,068 entitled "Fastener Having Recessed Non-Circular Head, and Fastener-Driving Tool" issued on Apr. 12, 1994, commonly assigned herewith, and incorporated by reference herein.

The stand-up fastener driving tool 10 also includes a lower tube 30 telescopingly coupled to an upper tube 40 having an upper end 42 coupled to the rotary driver 12. The lower tube 30 has a lower end 32 biased away from the rotary driver 12 by a spring member 44 disposed within the upper tube 40. A nose-piece 50 is coupled to the lower end 32 of the lower tube 30, wherein the nose-piece 50 generally includes an opening 52 for retaining the fastener 2 in a fastener driving position aligned axially with the fastener driving member 20 disposed axially in the lower tube 30. The fastener driving member 20 is extendable toward the nose-piece 50 upon contraction of the lower tube 30 relative to the upper tube 40 against the bias of the compressed spring 44, and the fastener driving member 20 is retractable away from the nose-piece 50 upon extension of the lower tube 30 relative to the upper tube 40.

The nose-piece 50 of the exemplary embodiment of FIG. 1 includes two jaws 54 having corresponding fastener retaining ends 55, which are pivotally biased toward each other about a corresponding pivot 53 by a corresponding spring member 56 to at least partially define the opening 52 between the fastener retaining ends 55. The nose-piece 50 also includes two opposing plate members 58, only one of which is shown in FIG. 1*b,* coupled to the lower end 32 of the lower tube 30, pivotally supporting the two jaws 54, and defining sides of the opening 52. A tip 59 of the plate members 58 is depressably engageable against a deck, or workpiece, not shown, for contracting the lower tube 30 relative to the upper tube 40, whereupon the fastener driving member 20 is extendable toward the nose-piece 50 and is engageable with a fastener 2 retained between the jaws 54 thereof as the lower tube 30 is contracted relative to the upper tube 40. Further contraction of the lower tube 30 relative to the upper tube 40 extends the fastener 2 engaged by the fastener driving member 20 between the jaws 54, which are pivoted away from each other against the bias of spring members 56 so as to increase the opening 52 therebetween, thereby releasing the fastener 2 from the jaws 54, whereby the fastener 2 is installable into the workpiece. Various configurations of the fastener driving member 20 and the nose-piece 50 and the operation thereof are disclosed more fully in U.S. Pat. No. 5,302,068 entitled "Fastener Having Recessed Non-Circular Head, and Fastener-Driving Tool" issued on Apr. 12, 1994, commonly assigned herewith, and incorporated by reference herein.

Figure 4:
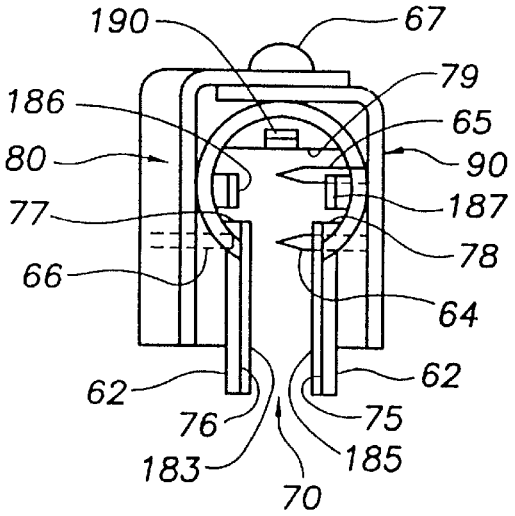
FIG. 4 is a partial end view of a fastener tube holder of the fastener driving tool of FIG. 1*a* as taken along lines 4—4 of FIG. 1*a* according to an exemplary embodiment of the invention.

FIGS. 1*a* and 4 illustrate the stand-up fastener driving tool 10 including a magazine 60 having a slot 70 between opposing guide rails 62 thereof and one or more upper and lower pins 64 and 66, which are generally horizontal and parallel, actuatably extendable into and retractable out of the magazine slot 70 for retaining a plurality of fasteners arranged side by side in an upper portion 71 thereof. The exemplary embodiment includes two upper pins 64 and 65 and only one lower pin 66, but other configurations may also include two lower pins or only one upper pin. The upper pins 64 and 65 are extended into the magazine slot 70 and the lower pin 66 is retracted out of the magazine slot 70 as the lower tube 30 is extended relative to the upper tube 40, wherein the upper pins 64 and 65 retain the plurality of fasteners in the upper portion 71 of the magazine slot 70 as shown. Only a single fastener 4 is shown in FIG. 1*a* so as to reduce the complexity of the drawing. The lower pin 66 is substantially alternately extendable into the magazine slot 70 and the upper pin 64 is retractable out of the magazine slot 70 as the lower tube 30 is contracted relative to the upper tube 40, wherein the lower pin 66 retains the plurality of fasteners in the upper portion 71 of the magazine slot 70 as discussed below. In some configurations, both the upper and lower pins 64 and 66 may be extended into the magazine 60 simultaneously during some phase of the contraction and extension of the upper and lower tubes 30 and 40.

Figure 2:
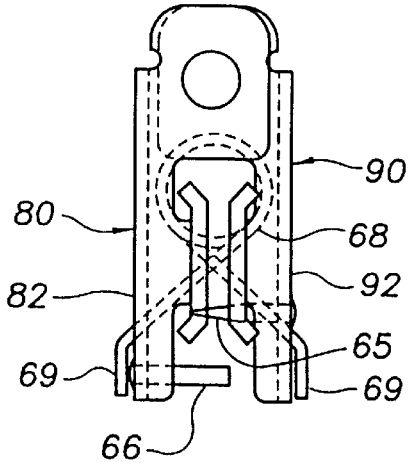
FIG. 2 is a partial side view of a fastener magazine dispenser assembly of the fastener driving tool of FIG. 1*a* as taken along lines 2—2 of FIG. 1*a* according to an exemplary embodiment of the invention.

FIGS. 2, 3 and 4 illustrate the lower pin 66 coupled to a first pivotal member 80, and the upper pins 64 and 65 coupled to a second pivotal member 90, wherein the upper and lower pins 64, 65, 66 are biased to extend into the magazine slot 70. More particularly, the first and second pivotal members 80 and 90 are pivotally coupled to the magazine 60 by a common bolt or other fastening member 67 about which they pivot. FIG. 2 shows a spring member 68, configured as a torsional spring having corresponding legs 69 coupled to corresponding outer sides 82 and 92 of the first and second pivotal members 80 and 90 so as to pivot the first and second pivotal members 80 and 90 toward each other, thereby biasing the upper and lower pins 64, 65 and 66 toward each other and into the magazine slot 70.

Figure 3D:
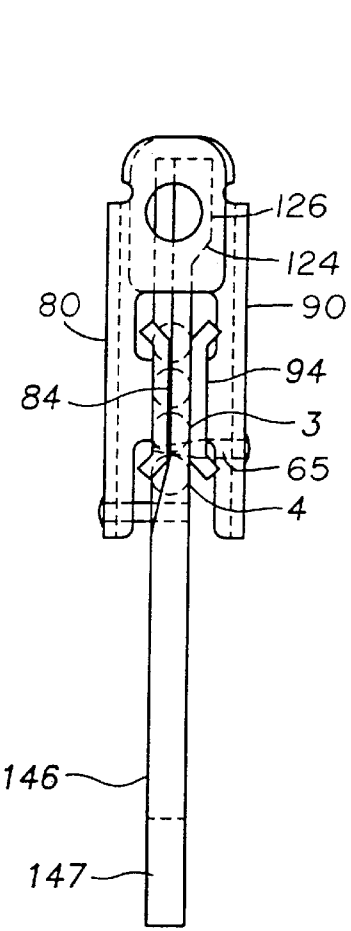
FIGS. 3*a*–3*d* are additional partial views of the fastener magazine dispenser assembly also taken along lines 2—2 of FIG. 1*a* in various stages of operation according to an exemplary embodiment of the invention.
Figure 3C:
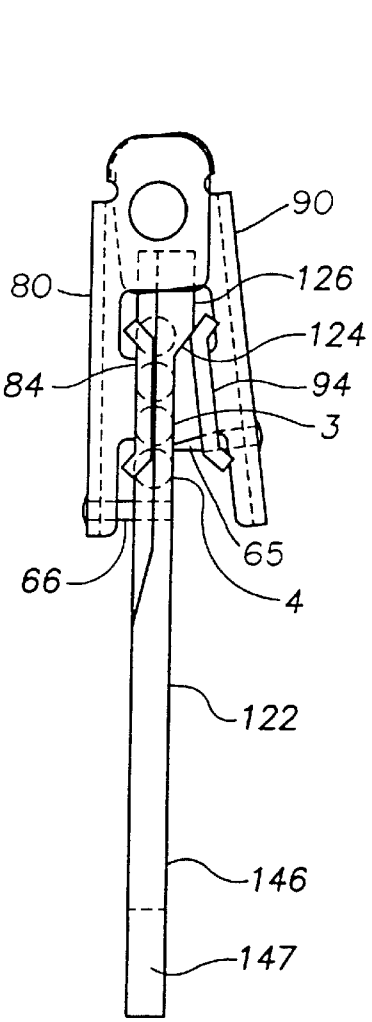

FIG. 1*a* illustrates a cam member 100 actuatably coupled to the upper tube 40 and movable relative to the magazine 60 upon contraction and extension of the lower tube 30 relative to the upper tube 40. In FIGS. 3*a*–3*d,* a first cam surface 110 of the cam member 100 pivots the first pivotal member 80 so as to retract the lower pin 66 from the magazine slot 70 as the lower tube 30 is extended relative to the upper tube 40, and a second cam surface 120 of the cam member 100 pivots the second pivotal member 90 so as to retract the upper pins 64 and 65 from the magazine slot 70 as the lower tube 30 is contracted relative to the upper tube 40, whereby the cam member 100 pivots the first and second pivotal members 80 and 90 against the bias of the spring member 68. Thus, the upper pin or pins 64 and 65 remain extended into the magazine slot 70 as the lower pin 66 is retracted out of the magazine slot 70 when the lower tube 30 is extended relative to the upper tube 40 so that the upper pins 64 and 65 retain the plurality of fasteners in the magazine as shown in FIG. 3*a*. Similarly, the lower pin 66 remains extended into the magazine slot 70 as the upper pins 64 and 65 are retracted out of the magazine slot 70 when the lower tube 30 is contracted relative to the upper tube 40 so that the lower pin 66 retains the plurality of fasteners in the magazine as shown in FIG. 3*c*.

Both the lower and upper pins 64, 65 and 66 are extended into the magazine slot 70 as the lower tube 30 is moved relative to the upper tube 40 between the fully extended and fully contracted positions. Thus, in FIG. 3*b* both the upper and lower pins 64, 65 and 66 are extended into the magazine slot 70 as cam member 100 moves downwardly from the configuration in FIG. 3*a* to the configuration in FIG. 3*c*, which occurs as the lower tube 30 moves relative to the upper tube 40 from the extended position to the contracted position. Similarly, in FIG. 3*d* both the upper and lower pins 64, 65 and 66 are extended into the magazine slot 70 as cam member 100 moves upwardly from the configuration in FIG. 3*c* to the configuration in FIG. 3*a*, which occurs as the lower tube 30 moves relative to the upper tube 40 from the contracted position to the extended position.

In the exemplary embodiment of FIGS. 1, 2 and 3, the first pivotal member 80 has a first cam engaging member 84 engageable with the first cam surface 110 of the cam member 100, and the second pivotal member 90 has a second cam engaging member 94 engageable with the second cam surface 120 of the cam member 100. In FIGS. 3*a*–3*d*, more particularly, the first cam surface 110 includes a first protruding surface portion 112 engageable with the first cam engaging member 84 when the lower tube 30 is extended relative to the upper tube 40 so as to pivot the first pivoting member 80 against the bias of the spring member 68, which is shown in FIGS. 1*a* and 2, thereby retracting the lower pin 66 from the magazine slot 70 as shown in FIG. 3*a*. As the cam member 100 moves downwardly from the configuration in FIG. 3*a* to the configuration in FIG. 3*b*, the first cam engaging member 84 moves along a first sloping surface portion 114 to a first recessed surface portion 116 of the first cam surface 110 so as to pivot the first pivoting member 80 under the bias of the spring member 68, thereby extending the lower pin 66 into the magazine slot 70 as shown in FIG. 3*b*. The upper pins 64 and 65 remain extended into the magazine slot 70 as the cam member 100 moves downwardly from the configuration in FIG. 3*a* to the configuration in FIG. 3*b*, which results from the second cam engaging member 94 moving along a second recessed portion 122 of the second cam surface 120.

Figure 3B:
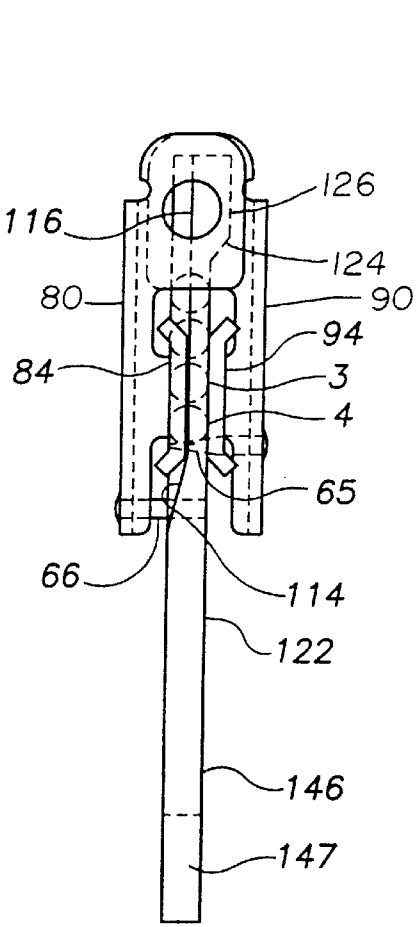
Figure 3A:
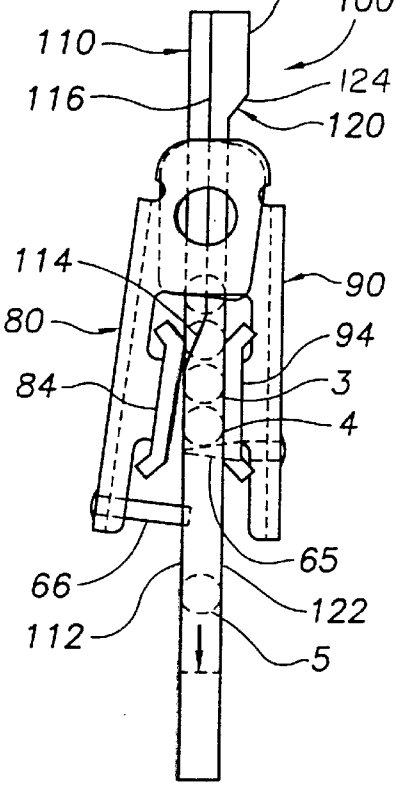

Also, in FIGS. 3*a*–3*d*, as the cam member 100 continues to move downwardly from the configuration in FIG. 3*b* to the configuration in FIG. 3*c*, the second cam engaging member 94 moves from the recessed surface portion 122 along a second sloping surface portion 124 to a second protruding surface portion 126 of the second cam surface 120 so as to pivot the second pivoting member 90 against the bias of the spring member 68, thereby retracting the upper pins 64 and 65 from the magazine slot 70 as shown in FIG. 3*c*. The lower pin 66 remains extended into the magazine slot 70 as the cam member 100 moves downwardly from the configuration in FIG. 3*b* to the configuration in FIG. 3*c*, which results from the first cam engaging member 84 moving along the first recessed surface portion 116 of the first cam surface 110. The cycle is then reversed as the cam member 100 moves upwardly from the configuration in FIG. 3*c* to the configuration in FIG. 3*d* and back to the configuration in FIG. 3*a*, as the lower tube 30 is extended relative to the upper tube 40.

As the cam member 100 moves downwardly from the configuration of FIG. 3*a* to the configuration of FIG. 3*c*, the plurality of fasteners disposed side by side in the upper portion 71 of the magazine slot 70, initially retained by the upper pins 64 and 65, is lowered in the magazine slot 70 and retained therein by the lower pin 66, as discussed above. Then, as the cam member 100 moves upwardly from the configuration of FIG. 3*c* to the configuration of FIG. 3*a*, both the upper and lower pins 64, 65 and 66 are extended into the magazine slot 70, wherein a lowermost fastener 4 of the plurality of fasteners is retained by the lower pin 66 and the next higher fastener 3 is retained by the upper pins 64 and 65 as shown in FIG. 3*d*. The lowermost fastener 4 is ultimately released by retracting the lower pin 66 as the cam member 100 moves upwardly, which occurs as the lower tube 30 moves relative to the upper tube 40 from the contracted position to the extended position, similar to the release of fastener 5 shown in FIG. 3*a*. According to this aspect of the invention, the plurality of fasteners are individually and sequentially advanced and released from the upper portion 71 of the magazine slot 70 toward a feed tube 130 interconnecting the magazine 60 and the nose-piece 50 upon contraction and extension of the lower tube 30 relative to the upper tube 40, whereby the fastener released from the upper portion 71 of the magazine 60 is fed by gravity along the magazine slot 70 toward the feed tube 130 as discussed further below.

FIG. 1*a* illustrates an upper portion 71 of the magazine slot 70 having a fastener inlet 73, and a lower curved portion 74 of the magazine slot 70 coupled to the feed tube 130. The upper portion 71 of the magazine slot 70 orients the fastener shanks disposed therein side by side generally non-parallel to an axis of the feed tube 130, and the curved portion 74 of the magazine slot 70 subsequently orients the fastener shanks disposed therein substantially parallel to the axis of the feed tube 130 where the magazine 60 is coupled to the feed tube 130, whereby the shank of a fastener released from the upper portion 71 of the magazine slot 70 and fed toward the feed tube 130 becomes more axially aligned with the axis of the feed tube 130 as the fastener moves along the lower curved portion 74 of the magazine slot 70 toward the feed tube 130.

FIG. 4 illustrates the magazine slot 70 having a substantially T-shaped cross section for receiving and retaining a fastener 4 having generally a shank portion and a head portion. The magazine slot 70 cross-sectional shape is defined generally by opposing side walls 75 and 76 adjacent the fastener shank, oppositely extending side wall shoulders 77 and 78 adjacent a bottom surface of the fastener head, and an end wall 79 adjacent a top surface of the fastener head.

Figure 5A:
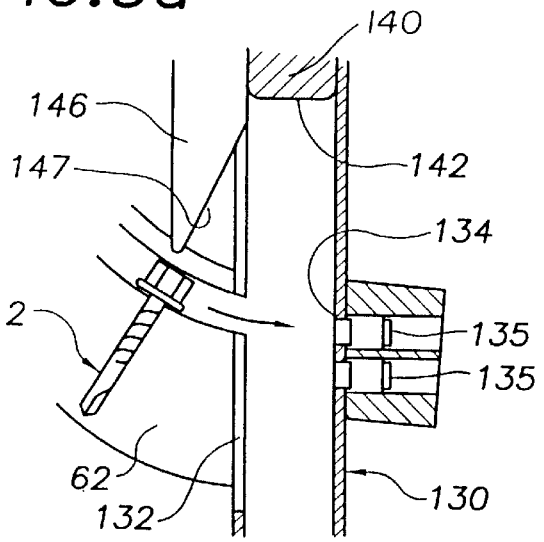
FIGS. 5*a*–5*c* are partial sectional views of a plunger assembly of the stand-up fastener driving tool in various stages of operation according to an exemplary embodiment of the invention.
Figure 5B:
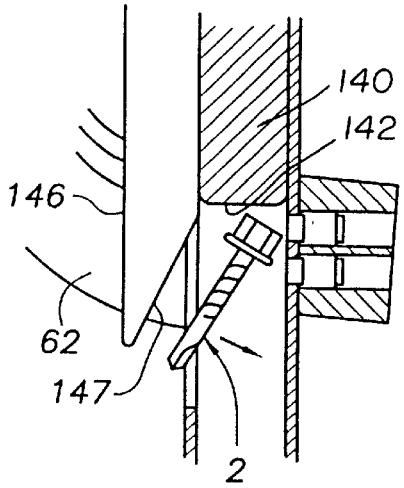
Figure 5C:
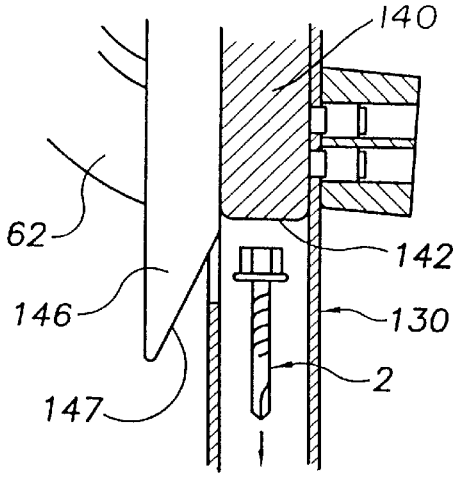

FIGS. 5*a*–5*c* illustrate the feed tube 130 having an opening 132 coupled with the magazine slot 70 so as to permit passage of fasteners 2 released from the lower curved portion 74 of the magazine slot 70 to enter into the feed tube 130. The feed tube 130 has a magnetized wall portion 134, formed by one or more magnets 135 mounted therein, substantially opposite the feed tube opening 132, whereby a fastener 2 fed from the magazine slot 70 to the feed tube 130 is retained along the magnetized wall portion 134 of the feed tube 130 as shown in FIG. 5*b*. Thus as the lower tube 30 is extended relative to the upper tube 40, a fastener is released from the upper portion 71 of the magazine 60, as discussed above, and gravity fed to the feed tube 130, where the fastener is captured by and retained along the magnetized wall portion 134 thereof.

FIGS. 1 and 5 also illustrate a plunger 140 actuatably coupled to the upper tube 40, wherein the plunger 140 is movable relative to the feed tube 130 so as to release a fastener retained along the magnetized wall portion 134 of the feed tube 130 as the lower tube 30 is contracted relative to the upper tube 40. In the exemplary embodiment, the plunger 140 has an engagement surface 142 and is reciprocatably disposed in the feed tube 130. FIG. 1*a* illustrates the plunger 140 biased by a spring member 144 away from the magnetized wall portion 134 when the lower tube 30 is extended relative to the upper tube 40 so as to provide an unobstructed passage through the feed tube opening 132 between the magazine slot 70 and the feed tube 130. The engagement surface 142 of the plunger 140 is thus movable axially along the feed tube 130 against the bias of the spring member 144 so as to engage a head of a fastener retained along the magnetized wall portion 134 as the lower tube 30 is contracted relative to the upper tube 40 as shown in FIGS. 5*b* and 5*c,* whereby the fastener released from the magnetized wall portion 134 is fed by gravity to the nose-piece 50.

The fastener released from the magnetized wall portion 134 of the feed tube 130 does not pass immediately into the opening 52 of the nosepiece 50 since the fastener driving member 20 is extended toward the nose-piece 50 as the lower tube 30 is contracted relative to the upper tube 40, which is the same action that moves the plunger 140 against the bias of the spring member 144 so as to release the fastener from the magnetized wall portion 134. The fastener driving member 20 thus obstructs passage of the released fastener from the feed tube 130 into the opening 52 of the nose-piece 50 until the lower tube 30 is extended relative to the upper tube 40, thereby retracting the fastener driving member 20 away from the nose-piece 50, whereupon the fastener is subsequently positioned and retained between movable jaws 54 of the nose-piece 50 in the fastener driving position aligned axially with the fastener driving member 20 as discussed above. Also, another fastener is released from the magazine 60 and fed to and retained along the magnetized wall portion 134 of the feed tube 130 while the lower tube 30 is extended relative to the upper tube 40.

According to a related aspect of the invention, shown in FIGS. 1 and 5, the plunger 140 includes a blade member 146 with a lower angled tip 147 protruding beyond the engagement surface 142 thereof. The angled tip 147 of the blade member 146 is extendable into the magazine slot 70 between the guide rails 62 as the lower tube 30 is contracted relative to the upper tube 40, whereby the angled tip 147 of the blade member 146 is engageable with a shank portion of a fastener retained along the magnetized wall portion 134 so as to rotate the fastener and more substantially axially align the fastener shank with the axis of the feed tube 130 before the fastener head is engaged by the engagement surface 142 of the plunger 140 to release the fastener from the magnetized wall portion 134, as shown in FIGS. 5*b* and 5*c*.

FIG. 1*a* illustrates the cam member 100 and the plunger 140 forming an assembly reciprocatably coupled to the feed tube 130, wherein the blade member 146 with the angled tip 147 is formed on a lower end of the cam member 100 as shown also in FIGS. 3*a*–3*d*. A bracket member 150 with a quick release wing nut and bolt assembly 152, shown partially and known generally, releasably couples the magazine 60 to a flange 160 coupled to an upper portion 34 of the lower tube 30 disposed within the upper tube 40. The flange 160 protrudes substantially radially from the lower tube 30 through a longitudinal slot along the upper tube 40, thereby permitting extension and contraction of the lower tube 30 relative to the upper tube 40. The upper tube 40 includes a collar 46 disposed thereabout as shown in FIG. 1*a*. The collar 46 is engageable with a flange 148 coupled to the plunger 140 by means of a sleeve 149 reciprocatably disposed about the feed tube 130 as the lower tube 30 is contracted relative to the upper tube 40, thereby moving the cam member 100 and plunger 140 assembly downwardly against the bias of the spring member 144, wherein the spring member 144 moves the cam member 100 and the plunger 140 assembly upwardly as the lower tube 30 is extended relative to the upper tube 40.

FIG. 1*b* illustrates a lower portion 137 of the feed tube 130 disposed in a mounting block 170 with a passage 172 therethrough for feeding fasteners from the feed tube 130 to the nose-piece 50. The mounting block 170 includes a recessed surface 174 matably coupleable to the lower portion 32 of the lower tube 30, wherein the passage 172 of the mounting block 170 communicates with the opening 52 of the nose-piece 50. The mounting block 170 includes two feet members 176 extending laterally outwardly from opposite sides thereof. The feet members 176 are releasably disposable in complementary shaped recesses 177 formed in a collar member 178 coupled to the lower portion 32 of the lower tube 30, wherein the feet members 176 are supportable on an upper surface 179 of the nose-piece 50. According to this aspect of the invention, the magazine 60 and the feed tube 130 form an assembly that is readily and releasably adaptable to a stand-up fastener driver tool, including for example existing stand-up fastener driver tools available commercially from ITW Buildex, Itasca, Ill. under the trademarks Autotraxx™ and Fastraxx™.

Figure 6A:
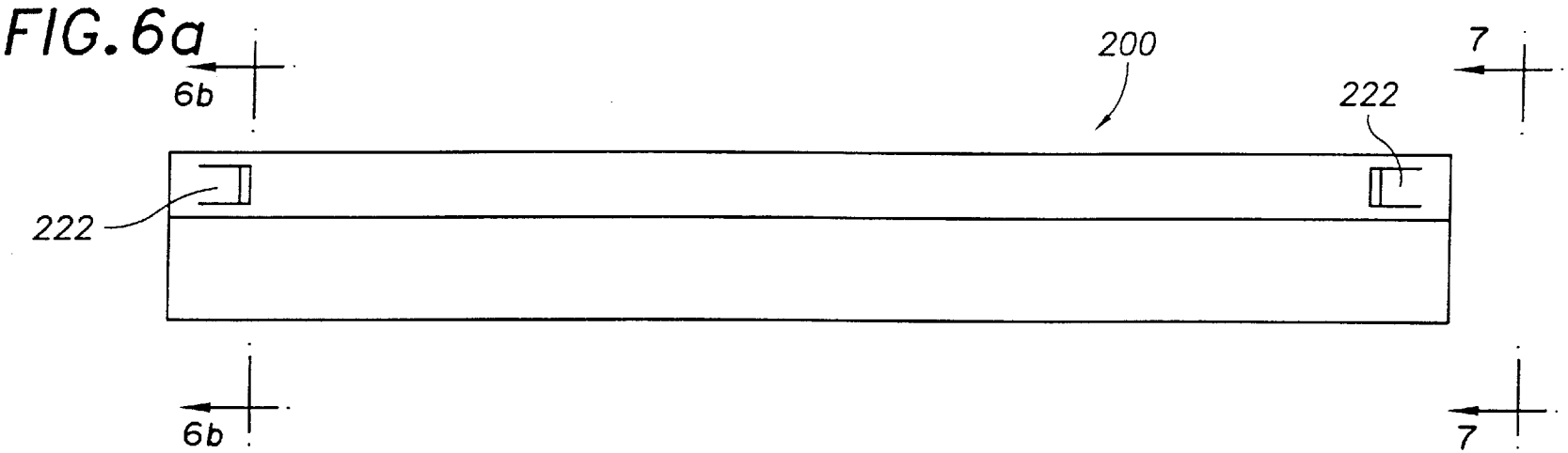
FIG. 6*a* is a side elevational view of a fastener collation tube useable in combination with the stand-up fastener driving tool of FIG. 1*a*.
Figure 8:
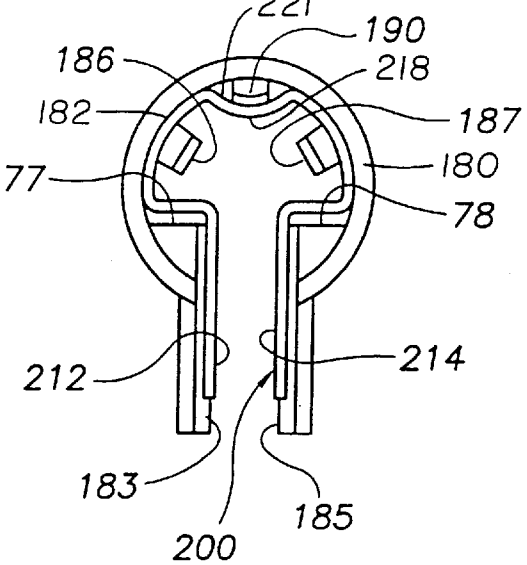
FIG. 8 is another partial end view of the fastener tube holder of the fastener driving tool of FIG. 1*a* as taken along lines 4—4 of FIG. 1*a* also illustrating the fastener collation tube disposed in the fastener tube holder.

FIG. 1*a* illustrates the magazine 60 coupled to a tube holder 180 including a longitudinal channel 182 for receiving a fastener collation tube 200, shown also in FIG. 6*a*. The channel 182 of the tube holder 180 is aligned with and coupled to the upper portion 71 of the magazine slot 70. FIG. 8 illustrates edge portions 183 and 185 formed on a portion of the magazine 60 toward the tube holder 180, wherein the edge portions 183 and 185 form an abutment surface against which the fastener collation tube 200 is seatable when disposed in the tube holder 180.

Figure 7:
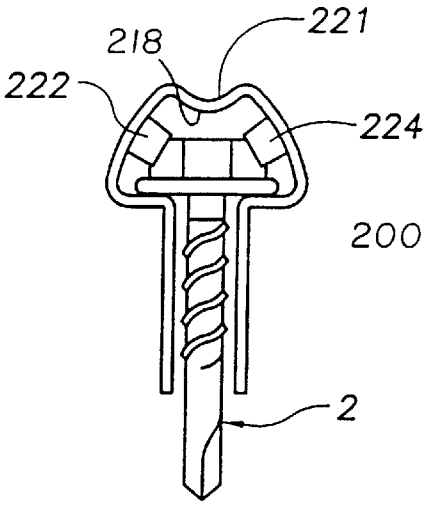
FIG. 7 is an end view of the fastener collation tube FIG. 6*a* as taken along lines 7—7 of FIG. 6*a,* illustrating also a fastener retained in a channel of the fastener collation tube.
Figure 6B:
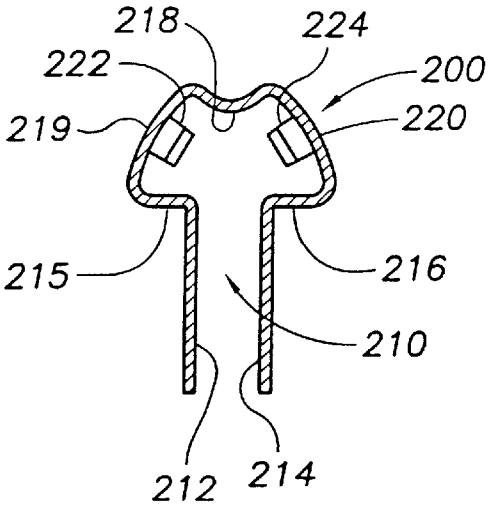
FIG. 6*b* is a sectional view of the fastener collation tube of FIG. 6*a* as taken along lines 6*b*—6*b* of FIG. 6*a*.

FIGS. 6*b* and 7 illustrate the fastener collation tube 200 having a channel 210 for retaining a plurality of fasteners 2, which generally include a head and a shank, arranged side by side therein. The fasteners in the exemplary embodiment are screw fasteners. The fastener collation tube 200 is removably disposable in the channel 182 of the tube holder 180 so as to couple the channel 210 of the fastener collation tube 200 with the magazine slot 70, whereby the plurality of fasteners arranged side by side in the fastener collation tube 200 are transferrable to and disposable in the upper portion 71 of the magazine slot 70.

The fastener collation tube 200 may be removed from channel 182 of the tube holder 180 upon transferring the fasteners into the magazine 60, since a supply of fasteners is retained in the upper portion 71 of the magazine slot 70 for use during operation of the stand-up fastener driving tool 10. Alternatively, the fastener collation tube 200 may remain in the channel 182 of the tube holder 180 during operation of the tool 10, whereby the channel 210 of the fastener collation tube 200 extends the upper portion 71 of the magazine slot 70. The fasteners are alternatively manually disposable directly into the inlet 184 of the tube holder 180 and into the magazine slot 70 without the fastener collation tube 200.

FIGS. 6*b* and 7 illustrate the channel 210 of the fastener collation tube having a substantially T-shaped cross section defined by opposing side walls 212 and 214 adjacent the fastener shank, oppositely extending side wall shoulders 215 and 216 adjacent a bottom surface of the fastener head, and an end wall 218 adjacent a top surface of the fastener head. The fastener collation tube 200 includes a fastener retaining member on at least one end thereof, and in the exemplary embodiment of FIGS. 6*a,* 6*b* and 7 the fastener retaining member comprises resilient tabs 222 and 224 protruding from corresponding crown portions 219 and 220 between corresponding shoulders 215 and 216 and the end wall 218 and into the channel 210 of the fastener collation tube 200. The resilient tabs 222 and 224 retain the plurality of fasteners 2 in the channel 210 of the fastener collation tube 200, and in the exemplary embodiment corresponding pairs of resilient tabs 222 and 224 are disposed on opposite ends of the fastener collation tube 200. In alternative embodiments, however, one end of the fastener collation tube 200 may be capped or blocked by other means, and the resilient tabs 222 and 224 may be disposed near or on only one end of the elongated body member 208. In other alternative embodiments, a single resilient tab extends into the channel 210 of the elongated body member 208 from only one of the opposing side walls 212 and 214, or from opposing crown portions 219 and 220, or from the end wall 218 thereof. And in other alternative embodiments, the fastener retaining member is a crimped, or a twisted, or a bent end portion of the elongated body member 208.

FIGS. 1*a* and 8 illustrate prongs 186 and 187 extending into the tube holder 180 and engageable with corresponding resilient tabs 222 and 224 of the fastener collation tube 200 so as to flex the resilient tabs 222 and 224 out of the channel 210 of the fastener collation tube 200 when the fastener collation tube 200 is disposed in the channel 182 of the tube holder 180, whereby the fasteners 2 retained side by side in the fastener collation tube 200 are released therefrom and transferred into the magazine slot 70 when the resilient tabs 222, 224 are flexed out of the channel 210 of the fastener collation tube 200. A corresponding single prong flexes the tab in configurations of the fastener collation tube 200 having only one resilient tab protruding into the channel 210 thereof. According to this aspect of the invention, generally, a plurality of fasteners are securely retained in the fastener collation tube 200, which is readily loadable into the tube holder 180 of the stand-up fastener driving tool 10 so as to transfer the plurality of fasteners into the magazine slot 70 thereof, and more particularly into the upper portion 71 thereof. The fastener collation tube 200 is also removable from the tube holder 180 and is reusable upon reloading a plurality of fasteners therein.

FIGS. 1*a,* 4 and 8 illustrate an alignment prong 190 extendable away from the end wall 79 of the magazine slot 70 and engageable with a top side 221 of the fastener collation tube 200 opposite the end wall 218 thereof. The alignment prong 190 is disposed at an angle relative to the axis of the tube holder 180 so as to engage and bias the fastener collation tube 200 toward the shoulders 77 and 78 of the magazine slot 70 as the fastener collation tube 200 is disposed in the channel 182 of the tube holder 180. The alignment prong 190 thus aligns or positions the end wall 218 of fastener collation tube 200 relative to the end wall 79 of the magazine slot 70 when the fastener collation tube 200 is fully disposed within the channel 182 of the tube holder 180 so as to prevent obstruction of the fasteners by the end wall 79 of the magazine slot 70 as the fasteners are transferred from the fastener collation tube 200 into the upper portion 71 of the magazine slot 70.

FIG. 8 illustrates end portions of the opposing side walls 212 and 214 of the fastener collation tube 200 supportably disposed on the edge portions 183 and 185 of the magazine 60, which are correspondingly aligned with the opposing side walls 212 and 214 thereby providing support for the fastener collation tube 200. The edge portions 183 and 185, also shown in FIG. 4, thus form an abutment surface against which the fastener collation tube 200 is seatable when disposed in the tube holder 180. The fastener collation tube 200 is generally retained in the tube holder 180 by frictional forces therebetween, which permits operation of the stand-up fastener driving tool 10 when the fastener collation tube 200 is disposed in the tube holder 180, without separation of the fastener collation tube 200 therefrom during operation and handling of the stand-up fastener driving tool 10.

In operation, generally, a plurality of fasteners are securely retained in the fastener collation tube 200, which is readily loadable into the tube holder 180 of the stand-up fastener driving tool 10 so as to transfer the plurality of fasteners into the magazine slot 70 thereof. The fastener collation tube 200 may be removed from the tube holder 180 upon transferring the fasteners therefrom into the upper portion 71 of the magazine slot 70, whereupon the stand-up fastener driving tool 10 is operational without the fastener collation tube 200. As discussed above, however, the stand-up fastener driving tool 10 is operational with the fastener collation tube 200 disposed in the tube holder 180. The fastener collation tube 200 is also readily removable from the tube holder 180 when depleted of fasteners, and is reusable upon reloading a plurality of fasteners therein. Tool operators may thus carry several fastener collation tubes 200 loaded with fasteners, and conveniently load the fastener collation tubes 200 into the tube holder 180 of the stand-up fastener driving tool 10 whether or not fasteners remain in the upper portion 71 of the magazine slot 70 thereby permitting relatively uninterruptable operation of the tool 10.

While the foregoing written description of the invention enables anyone skilled in the art to make and use what is at present considered to be the best mode of the invention, it will be appreciated and understood by anyone skilled in the art the existence of variations, combinations, modifications and equivalents within the spirit and scope of the specific exemplary embodiments disclosed herein. The present invention therefore is to be limited not by the specific exemplary embodiments disclosed herein but by all embodiments within the scope of the appended claims.

What is claimed is:

1. A stand-up fastener driving tool comprising:

a rotary driver having a rotatable shaft with a fastener driving member disposed upon a distal end of said rotatable shaft;

an upper tube having an upper end coupled to said rotary driver;

a lower tube telescopingly connected to said upper tube and having a lower end biased away from said rotary driver by a spring member disposed within said upper tube;

a nose-piece coupled to said lower end of said lower tube and having an opening for retaining a fastener at a fastener driving position axially aligned with said fastener driving member which is axially disposed within said lower tube;

said fastener driving member being extendable toward said nose-piece upon contraction of said lower tube relative to said upper tube and against the bias of said spring member, and being retractable away from said nose-piece upon extension of said lower tube relative to said upper tube;

a magazine having a slot within which a plurality of fasteners are able to be disposed in a side-by-side manner;

a feed tube interconnecting said magazine and said nose-piece so as to conduct the fasteners from said magazine to said nose-piece;

upper and lower pin assemblies movably mounted upon opposite sides of said magazine such that upper and lower pins of said upper and lower pin assemblies are actuatably extendable into and retractable out from said magazine slot; and means operatively connected to said upper tube and engageable with said upper and lower pin assemblies such that said upper pin is extended into said magazine slot and said lower pin is retracted out of said magazine slot as said lower tube is extended relative to said upper tube, and said lower pin is extended into said magazine slot and said upper pin is retracted out of said magazine slot as said lower tube is contracted relative to said upper tube, whereby lowermost fasteners of the plurality of fasteners can be serially released from said magazine and fed toward said feed tube upon extension of said lower tube relative to said upper tube.

2. The stand-up fastener driving tool of claim 1, wherein:

said means operatively connected to said upper tube and engageable with said upper and lower pin assemblies comprises a cam member movable relative to said magazine upon contraction and extension of said lower tube relative to said upper tube and comprising first and second cam surfaces;

said upper and lower pin assemblies comprising pivotal members with said lower pin being coupled to a first pivotal member of said lower pin assembly, and said upper pin being coupled to a second pivotal member of said upper pin assembly, the upper and lower pins being biased so as to extend into said magazine slot; and said first cam surface of said cam member pivoting said first pivotal member of said lower pin assembly so as to retract said lower pin from said magazine slot as said lower tube is extended relative to said upper tube, and said second cam surface of said cam member pivoting said second pivotal member of said upper pin assembly so as to retract said upper pin from said magazine slot as said lower tube is contracted relative to said upper tube.

3. The stand-up fastener driving tool of claim 2, wherein:

said first pivotal member and said second pivotal member are pivotally coupled to said magazine about a common pivot point;

a spring member is operatively coupled to said first pivotal member and said second pivotal member so as to bias said upper pin and said lower pin into said magazine slot; and said first pivotal member has a first cam engaging member engageable with said first cam surface of said cam member, and said second pivotal member has a second cam engaging member engageable with said second cam surface of said cam member, whereby said cam member pivots said first pivotal member and said second pivotal member against the bias of said spring member.

4. The stand-up fastener driving tool of claim 1, wherein:

said feed tube comprises a longitudinal axis; and said magazine slot has a first portion and a curved portion wherein said first portion of said magazine slot orients the fastener shanks in a non-parallel mode with respect to said axis of said feed tube, while said curved portion of said magazine slot orients the fastener shanks substantially parallel to said axis of said feed tube whereby a shank of a fastener fed from said magazine toward said feed tube is aligned substantially axially with said axis of said feed tube as the fastener approaches said feed tube.

5. The stand-up fastener driving tool of claim 1, the magazine slot having a substantially T-shaped cross section for receiving and retaining a fastener having a shank and a head, the magazine slot defined by opposing side walls adjacent the fastener shank, opposing side wall shoulders adjacent a bottom surface of the fastener head, and an end wall adjacent a top surface of the fastener head.

6. The stand-up fastener driving tool of claim 1, the feed tube having an opening communicating with the magazine slot to permit passage of fasteners from the magazine slot to the feed tube, the feed tube having a magnetized wall portion, whereby a fastener fed from the magazine slot to the feed tube is retained along the magnetized wall portion of the feed tube.

7. The stand-up fastener driving tool of claim 6 further comprising a plunger actuatably coupled to the upper tube, the plunger movable relative to the feed tube to release a fastener retained along the magnetized wall portion of the feed tube as the lower tube is contracted relative to the upper tube.

8. The stand-up fastener driving tool of claim 7, the nose-piece having movable jaws for retaining a fastener, released from along the magnetized wall portion, in a fastener driving position aligned axially with the fastener driving member as the lower tube is extended relative to the upper tube, whereby the fastener driving member is engageable with the fastener retained between the jaws of the nose-piece as the lower tube is contracted relative to the upper tube so as to install the fastener into a workpiece.

9. The stand-up fastener driving tool of claim 7, the plunger having an engagement surface reciprocatably disposed in the feed tube, the plunger being biased by a spring member away from the magnetized wall portion when the lower tube is extended relative to the upper tube so as to provide an unobstructed passage between the magazine slot and the feed tube, and the engagement surface of the plunger being movable to engage a head of a fastener retained along the magnetized wall portion as the lower tube is contracted relative to the upper tube, whereby the fastener released from the magnetized wall portion is fed to the nose-piece.

10. The stand-up fastener driving tool of claim 7, the plunger having a blade member with a lower angled tip protruding beyond the engagement surface, the angled tip of the blade member extendable into the magazine slot as the lower tube is contracted relative to the upper tube, whereby the angled tip of the blade member is engageable with a shank of a fastener retained along the magnetized wall portion so as to more substantially axially align the shank with the feed tube axis before the fastener head is engaged by the engagement surface of the plunger and released from the magnetized wall portion.

11. The stand-up fastener driving tool of claim 10, wherein:

said means operatively connected to said upper tube and engageable with said upper and lower pin assemblies comprises a cam member coupled to said plunger and movable relative to said magazine upon contraction and extension of said lower tube relative to said upper tube and comprising first and second cam surfaces;

said upper and lower pin assemblies comprising pivotal members with said lower pin being coupled to a first pivotal member of said lower pin assembly, and said upper pin being coupled to a second pivotal member of said upper pin assembly; and said first cam surface of said cam member pivoting said first pivotal member of said lower pin assembly so as to retract said lower pin from said magazine slot as said lower tube is extended relative to said upper tube, and said second cam surface of said cam member pivoting said second pivotal member of said upper pin assembly so as to retract said upper pin from said magazine slot as said lower tube is contracted relative to said upper tube.

12. The stand-up fastener driving tool of claim 1 further comprising:

a tube holder coupled to the magazine, the tube holder having a channel coupled to the magazine slot; and a fastener collation tube having a channel for retaining a plurality of fasteners having a head and a shank, the fasteners being arranged side by side in the channel of the fastener collation tube, the fastener collation tube being disposable in the channel of the tube holder so as to couple the channel of the fastener collation tube with the magazine slot, whereby the plurality of fasteners arranged side by side in the fastener collation tube are transferrable to the magazine slot.

13. The stand-up fastener driving tool of claim 12, wherein at least one end of the fastener collation tube has a fastener retaining member so as to retain the plurality of fasteners in the channel of the fastener collation tube, a prong extending into the tube holder and engageable with the fastener retaining member so as to flex the fastener retaining member out of the channel of the fastener collation tube when the fastener collation tube is disposed in the channel of the tube holder, whereby the fasteners retained in the fastener collation tube are released from the fastener collation tube and into the magazine slot when the fastener retaining member is flexed out of the channel of the fastener collation tube.

14. The stand-up fastener driving tool of claim 13, wherein the channel of the fastener collation tube has a substantially T-shaped cross section defined by opposing side walls adjacent the fastener shank, opposing side wall shoulders adjacent a bottom surface of the fastener head, and an end wall adjacent a top surface of the fastener head.

15. The stand-up fastener driving tool of claim 14 further comprising an alignment prong extendable away from an end wall of the magazine slot and engageable with a top side of the fastener collation tube opposite the end wall of the fastener collation tube, the alignment prong aligning the end wall of the fastener collation tube with the end wall of the magazine slot when the fastener collation tube is disposed in the channel of the tube holder.

16. A method, for dispensing fasteners from a magazine of a stand-up fastener driving tool including a rotary driver having a rotatable shaft with a fastener driving member disposed upon a distal end of said rotatable shaft, an upper tube having an upper end coupled to said rotary driver, a lower tube telescopingly connected to said upper tube and having a lower end biased away from said rotary driver by a spring member disposed within said upper tube, a nose-piece coupled to said lower end of said lower tube and having an opening for retaining a fastener at a fastener driving position axially aligned with said fastener driving member which is axially disposed within said lower tube, said fastener driving member being extendable toward said nose-piece upon contraction of said lower tube relative to said upper tube and against the bias of said spring member, and being retractable away from said nose-piece upon extension of said lower tube relative to said upper tube, comprising the steps of:

providing a feed tube interconnecting said magazine and said nose-piece so as to conduct fasteners from said magazine to said nose-piece; and disposably retaining a plurality of fasteners in a side-by-side manner within a slot of said magazine, by means of upper and lower pin assemblies which are movably mounted upon opposite sides of said magazine and which are provided with upper and lower pins which are actuatably extendable into and retractable out from said magazine slot by extending said upper pin into said magazine slot and retracting said lower pin out of said magazine slot as said lower tube is extended relative to said upper tube, and extending said lower pin into said magazine slot and retracting said upper pin out of said magazine slot as said lower tube is contracted relative to said upper tube whereby lowermost fasteners of the plurality of fasteners can be serially released from said magazine and fed toward said feed tube, interconnecting said magazine and said nose-piece, upon extension of said lower tube relative to said upper tube.

17. The method of claim 16, wherein said stand-up fastener driving tool has a cam member operatively connected to said upper tube and movable relative to said magazine upon contraction and extension of said lower tube relative to said upper tube, and said upper and lower pin assemblies comprise pivotal members with said lower pin being coupled to a first pivotal member of said lower pin assembly, and said upper pin being coupled to a second pivotal member of said upper pin assembly, further comprising the steps of:

pivoting said first pivotal member of said lower pin assembly and coupled to said lower pin with a first cam surface of said cam member so as to retract said lower pin from said magazine slot as said lower tube is extended relative to said upper tube; and pivoting said second pivotal member of said upper pin assembly and coupled to said upper pin with a second cam surface of said cam member so as to retract said upper pin from said magazine slot as said lower tube is contracted relative to said upper tube.

18. The method of claim 17 further comprising biasing the upper pin and the lower pin into the magazine slot with a spring member coupled to the first pivotal member and the second pivotal member, whereby the cam member pivots the first pivotal member and the second pivotal member against the bias of the spring member.

19. The method of claim 16 further comprising substantially aligning a shank of a fastener released from the magazine with a longitudinal axis of the feed tube as the released fastener approaches the feed tube by feeding the released fastener toward the feed tube along a curved portion of said magazine slot.

20. The method of claim 16 further comprising feeding the released fastener from the magazine slot through an opening in the feed tube, and retaining the released fastener along a magnetized wall portion of the feed tube.

21. The method of claim 20 further comprising:

releasing the fastener retained along the magnetized wall portion by engaging a head of the fastener with a plunger reciprocatably disposed in the feed tube as the lower tube is contracted relative to the upper tube; and moving the plunger away from the magnetized wall portion of the feed tube when the lower tube is extended relative to the upper tube so as to provide an unobstructed passage between the magazine slot and the feed tube.

22. The method of claim 21 further comprising:

feeding the fastener released from along the magnetized wall portion of the feed tube through the feed tube toward the nose-piece;

positioning and retaining the fastener between movable jaws of the nose-piece in a fastener driving position aligned axially with the fastener driving member as the lower tube is extended relative to the upper tube;

engaging the fastener retained between the movable jaws of the nose-piece with the fastener driving member as the lower tube is contracted relative to the upper tube; and opening the movable jaws so as to release the fastener retained between the movable jaws as the lower tube is further contracted relative to the upper tube, whereby the fastener is installable into a workpiece.

23. The method of claim 21 further comprising engaging a shank of a fastener retained along the magnetized wall with an angled tip of a blade member so as to more substantially align the shank of the fastener with a longitudinal axis of the feed tube before the fastener head is engaged by the plunger and released from the magnetized wall portion.

24. The method of claim 16 further comprising retaining a plurality of fasteners side by side in a channel of a fastener collation tube, and disposing the fastener collation tube in a channel of a tube holder coupled to the magazine so as to dispose the plurality of fasteners arranged in a side by side manner in the magazine slot.

25. The method of claim 24 further comprising:

retaining the plurality of fasteners in the channel of the fastener collation tube with a fastener retaining member disposed toward at least one end of the fastener collation tube and engagable with fasteners in the channel of the fastener collation tube; and disengaging the fastener retaining member from the fasteners in the channel of the fastener collation tube with a prong extending into the tube holder when the fastener collation tube is disposed in the channel of the tube holder so as to release the fasteners from the fastener collation tube into the magazine slot.

* * * * *